US007617861B2

(12) United States Patent
Bovens

(10) Patent No.: US 7,617,861 B2
(45) Date of Patent: Nov. 17, 2009

(54) HARDENING OF INORGANIC FOUNDRY CORES AND MOLDS

(75) Inventor: Wilhelm Bovens, Kreuzlingen (CH)

(73) Assignee: Luber GmbH, Bazenheid (CH)

( * ) Notice: Subject to any disclaimer, the term of this patent is extended or adjusted under 35 U.S.C. 154(b) by 0 days.

(21) Appl. No.: 11/724,120

(22) Filed: Mar. 14, 2007

(65) Prior Publication Data

US 2007/0246182 A1 Oct. 25, 2007

(30) Foreign Application Priority Data

Apr. 24, 2006 (CH) ..... 0668/06

(51) Int. Cl.
*B22C 9/12* (2006.01)

(52) U.S. Cl. ..... 164/12; 164/16; 164/200

(58) Field of Classification Search ..... 164/16, 164/200, 201, 12

See application file for complete search history.

(56) References Cited

U.S. PATENT DOCUMENTS 4,162,238 A * 7/1979 Bergna ..... 524/442

7,036,552 B2 5/2006 Bovens ..... 164/200

FOREIGN PATENT DOCUMENTS

WO 03106072 * 12/2003

* cited by examiner

*Primary Examiner*—Kevin P Kerns
(74) *Attorney, Agent, or Firm*—Andrew Wilford

(57) ABSTRACT

A foundry core or mold comprised of sand admixed with an inorganic binder is hardened by passing a treatment gas through a first heater and heating it therein to a relatively low temperature and, in a first hardening stage, passing the gas at the low temperature from the first heater through a second heater and heating it therein to a relatively high temperature and thereafter passing the gas at the high temperature from the second heater to and through a core box holding the core or mold to harden same. Thereafter in an after-treatment stage passing the gas at the low temperature from the first heater substantially directly to and through the core box holding the core or mold to after treat same.

4 Claims, 1 Drawing Sheet

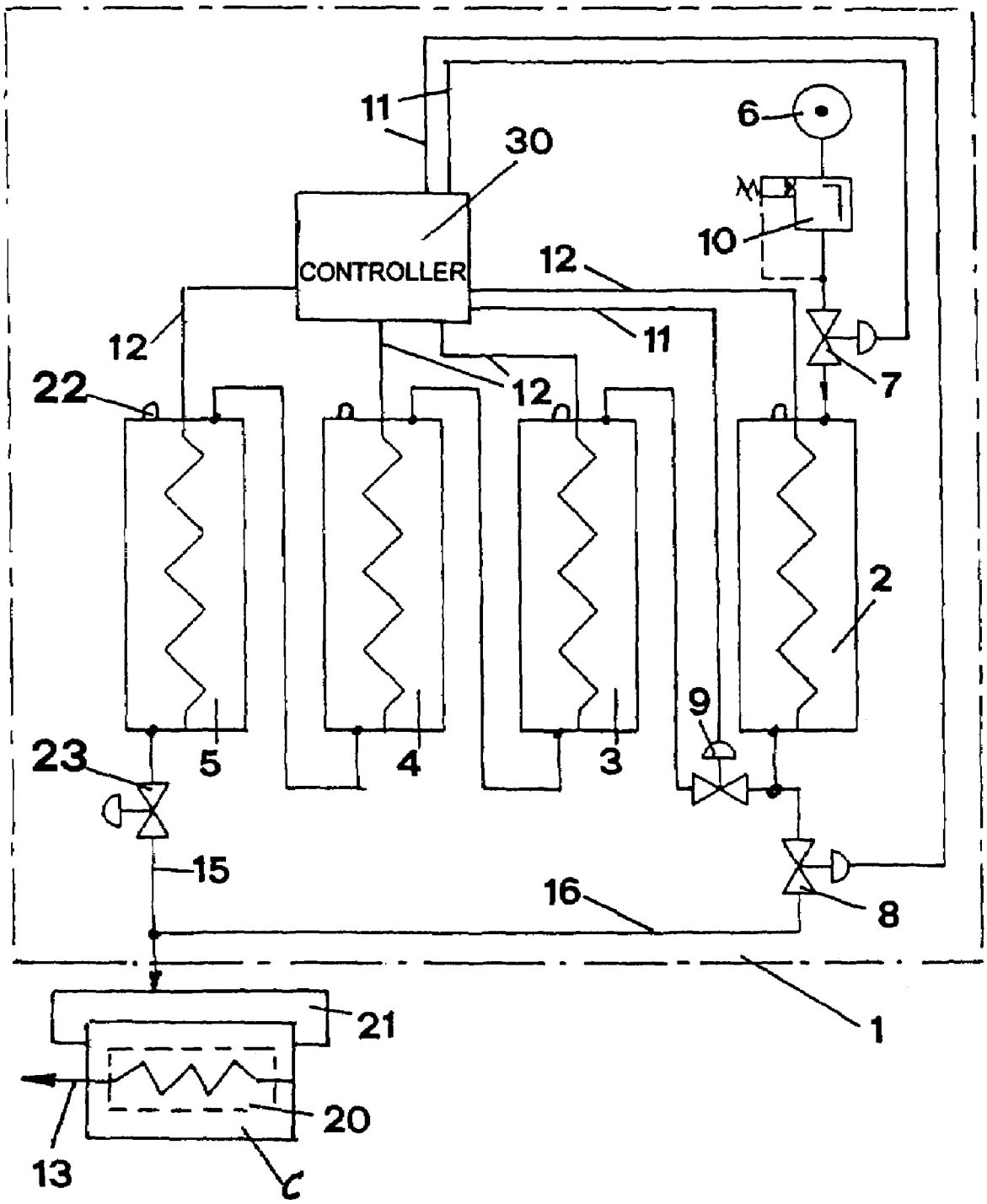
11
30
6
CONTROLLER
10
12
12
11
7
22
12
2
9
23
5
4
3
15
16
8
1
21
20
13

HARDENING OF INORGANIC FOUNDRY CORES AND MOLDS

FIELD OF THE INVENTION

The present invention relates to inorganic foundry cores and molds. More particularly this invention concerns a method and apparatus for hardening workpieces comprised of inorganic foundry cores and molds.

BACKGROUND OF THE INVENTION

A foundry core or mold of sand-containing molding materials with an inorganic binding system is hardened in a core box by exposure to a temperature predetermined for hardening the core or the mold.

It is standard in the so-called hot-box method to mix organic additives, such as for instance a phenol-based binding agent, with sand to make a wet core and to harden it in a mold by heating the mold to temperatures ranging from 200 to 270° C. Such a system can be very fast. The alternative is the cold-box method as described for example in U.S. Pat. No. 3,409,570 where the hardening takes place over hours or days and is typically effected by gasification. The hot-box method produces a somewhat weaker core, but is very fast, its main disadvantage being that it produces a considerable amount of noxious and even toxic emissions.

OBJECTS OF THE INVENTION

It is therefore an object of the present invention to provide an improved system for hardening inorganic foundry cores and molds.

Another object is the provision of such an improved system for hardening inorganic foundry cores and molds that overcomes the above-given disadvantages, in particular that is fast, produces relatively few toxic or offensive emissions, and that makes a workpiece of excellent properties.

SUMMARY OF THE INVENTION

A foundry core or mold comprised of sand admixed with an inorganic binder is hardened by passing a treatment gas through a first heater and heating it therein to a relatively low temperature and, in a first hardening stage, passing the gas at the low temperature from the first heater through a second heater and heating it therein to a relatively high temperature and thereafter passing the gas at the high temperature from the second heater to and through a core box holding the core or mold to harden same. Thereafter in an after-treatment stage passing the gas at the low temperature from the first heater substantially directly to and through the core box holding the core or mold to after treat same.

Thus in accordance with the inventive method in a first hardening cycle a stream of hot air is conducted through the core or the mold in the core box at a predetermined pressure, predetermined temperature, and for a predetermined time, and in a second, so-called after-treatment cycle for relaxing the core or the mold situated in the core box another stream of hot air is conducted through at a predetermined pressure, predetermined temperature, and for a predetermined time.

According to the invention, the stream of hot air is preheated in a first heating stage and in a second heating stage is heated to the predetermined final temperature for the hardening cycle, and the stream of hot air for the after-treatment cycle is supplied to the core box directly from the first heating stage bypassing the second heating stage.

More particularly in accordance with the invention the stream of hot air from the first heating stage is heated to a temperature up to about 80° C. and the stream of hot air from the second heating stage to a temperature range up to about 250° C.

Using the system of this invention and the exclusive use of inorganic binding agents, only extremely low emissions are released during the production of the core. The inventive method is suitable both for production of individual cores and molds and also and in particular for series production, the cores and molds attaining optimum properties.

The present invention furthermore relates to an apparatus for performing the above-described inventive method for hardening foundry cores and molds of sand-containing molding materials with an inorganic binding system in which the core or the mold in a core mold (core box) is exposed to a temperature predetermined for hardening the core or the mold.

This apparatus is inventively distinguished by a pressurized hot-air device that can be provided upstream of the core box for producing streams of hot air that can be conducted through the core or the mold in the core box at a predetermined pressure, predetermined temperature, and for a predetermined time.

One advantageous embodiment is comprised in that the pressurized hot-air device has an upstream flow heater and additional cascading, downstream flow heaters, the compressed air being delivered by means of a compressed air line via valve means having an upstream pressure regulator with proportional valve to the upstream flow heater, the outlet of which can be switched via valve means with the downstream flow heaters for a hardening cycle or is directly connected in the flow to the core box for an after-treatment cycle.

In another embodiment, each flow heater includes an electronic temperature regulator of a programmable electronic control system, the valves being connected to the control system.

BRIEF DESCRIPTION OF THE DRAWING

The above and other objects, features, and advantages will become more readily apparent from the following description, reference being made to the accompanying drawing whose sole FIGURE is a diagrammatic representation of an apparatus for carrying out the method of this invention.

SPECIFIC DESCRIPTION

As seen in the drawing an apparatus for hardening foundry cores or molds of sand-containing molding materials with an inorganic binding system is connected to a core mold (core box) 20 via a so-called gasification plate 21. It has a pressurized hot-air device 1 that can be provided upstream of the core box 20 and that produces streams of hot air that can be conducted at a predetermined pressure, predetermined temperature, and for a predetermined time through a core or a mold C in the core box 20. The core box 20 is set up such that a good flow of hot compressed air is provided through it in order to attain the lowest possible cycle times. Furthermore, the core box 20 can be attached to an unillustrated core shooter.

The pressurized hot-air device 1 has an upstream flow heater 2 with an output temperature for instance up to 80° C. as well as additional, in this case cascading, downstream flow heaters 3, 4, and 5 with an output temperature for instance up to 250° C. and higher for optimal heating of a stream of hot air intended for the core hardening in a first hardening cycle at a predetermined pressure, predetermined temperature, and for a predetermined time.

The compressed air required for this is supplied by means of a compressed air line 6 via a valve 7 of the upstream flow heater 2. The compressed air from the compressed air line with a pressure of no less than 5.0 bar is regulated to the required final pressure in a pressure regulator 10 via a proportional valve with the desired increase in pressure in a predetermined ramp time.

For core hardening in a first hardening cycle, the above-described valve 7 is opened at the side of the upstream flow heater 2 and a valve 9 in a pressure line an outlet of the flow heater 2 and the downstream flow heaters 3, 4, and 5 is opened so that the compressed air flowing therethrough travels at the predetermined temperature via a pressure line 15 from the outlet of the furthest downstream heater 5 into the core box 20 and flows therethrough. During this hardening stage another valve 8 in a direct line 16 connected between the outlet of the upstream flow heater 2 and the core box 20 is closed.

After the first hardening cycle has concluded, the two above-described valves 7 and 9 are preferably closed to start with.

For an after-treatment cycle for relaxing the core C in the core box 20, another stream of hot air is then conducted at a predetermined pressure but reduced temperature that is approximately the temperature at the end of the hardening cycle, and for a predetermined time, through the core box 20. To achieve this, the valve 9 is closed, the valve 7 on the inlet side of the upstream flow heater 2 is opened, and the valve 8 on the outlet side of the upstream flow heater 2 is opened so that the compressed hot air travels, at a predetermined low temperature, directly to the core box 20 through the upstream flow heater 2 via the pressure line 16 and regulator 10.

When the after-treatment cycle has concluded, the valves 7 and 8 are closed again.

In order to attain optimum hardening of the cores, each flow heater 2, 3, 4, and 5 is equipped with a discrete electronic temperature regulator such as shown at 22 for heater 5 as part of a programmable electronic controller 30 connected to the various heaters and sensors by control lines 12. The heating of the core box 20, on the other hand, is controlled from the unillustrated core shooter via a line 13. Furthermore, for switching purposes the above-described valves 7, 8, and 9 are also joined to the electronic control system via control lines 11.

Through the exclusive use of inorganic binding agent systems, only extremely low emissions are released by the inventive measures during core production. The inventive method and the inventive apparatus are suitable both for production of individual cores and molds and also and in particular for series production, the cores and molds attaining optimum properties.

Moreover, nearly all of the old sand can be completely reclaimed without complex regeneration after decoring. Since compared to the cold-box method no thermal regeneration is required, this system uses a regeneration system for sand-containing molding materials with an inorganic binding system that requires lower capital investment and less space than conventional thermal regeneration systems.

Variants are possible in the framework of this invention without departing from the inventive idea. For instance, instead of the two two-way valves 8 and 9, the stream, of hot air for the hardening cycle and the after-treatment cycle can also be regulated by means of a three-way valve. Moreover, an additional valve 23 can also be provided between the core box 20 in the pressure line 15 to the outlet side of the last flow heater 5 and in the pressure line 16 that can be controlled with the valve 8, in order to prevent flow back into pressure lines 16 and 15 during operation. Furthermore, the inorganic binding agents that can be used here and the core sand means can be variable.

I claim:

1. A method of hardening a foundry core or mold comprised of sand admixed with an inorganic binder, the method comprising the steps of:

passing hot air through a first heater and heating it therein to a relatively low temperature;

in a first hardening stage passing the hot air at the low temperature from the first heater through a second heater and heating it therein to a relatively high temperature and thereafter passing the hot air at the high temperature from the second heater to and through a core box holding the core or mold to harden same; and thereafter in a second after-treatment stage passing the hot air at the low temperature from the first heater substantially directly to and through the core box holding the core or mold to after treat same.

2. The hardening method defined in claim 1 wherein the low temperature is up to about 80° C.

3. The hardening method defined in claim 2 wherein the high temperature is up to about 250° C.

4. The hardening method defined in claim 1, further comprising the step of maintaining the hot-air stream passing through the first and second heaters at a superatmospheric pressure of about 5 bar.

* * * * *